US012240661B2

(12) United States Patent
Leung et al.

(10) Patent No.: US 12,240,661 B2
(45) Date of Patent: Mar. 4, 2025

(54) GASKET BODY, DETACHABLE SEALING COVER AND CONTAINER

(71) Applicant: Wai Shing Leung, Shatin (HK)

(72) Inventors: Wai Shing Leung, Shatin (HK); Wai Man Leung, Kowloon (HK)

(73) Assignee: Wai Shing Leung, Hong Kong (CN)

( * ) Notice: Subject to any disclaimer, the term of this patent is extended or adjusted under 35 U.S.C. 154(b) by 168 days.

(21) Appl. No.: 18/166,328

(22) Filed: Feb. 8, 2023

(65) Prior Publication Data

US 2024/0262575 A1 Aug. 8, 2024

(51) Int. Cl.
*B65D 43/02* (2006.01)
*B65D 53/02* (2006.01)

(52) U.S. Cl.
CPC ..... *B65D 43/0212* (2013.01); *B65D 2543/00277* (2013.01); *B65D 2543/00972* (2013.01)

(58) Field of Classification Search
CPC .. A47G 1/17; B65D 41/0442; B65D 43/0212; B65D 2313/04; B65D 2543/00277; B65D 2543/00972; B65D 2543/0024; B65D 2543/00092; B65D 2543/00564; Y10S 206/818; Y10S 428/90
USPC ..... 49/478.1; 215/341, 352, 45, 345, 337; 220/230, 315, 378, 304, 849, 795, 310.1, 220/789; 277/644, 921, 637, 641, 910, 277/626; 292/307 R, DIG. 11
See application file for complete search history.

(56) References Cited

U.S. PATENT DOCUMENTS 717,073 A * 12/1902 Cairns ..... B65D 41/28 215/277
727,808 A * 5/1903 Dallas ..... B65D 51/145 215/276
2,404,410 A * 7/1946 Smith ..... B65D 41/0442 215/354
2,716,504 A * 8/1955 Jean ..... B65D 41/0457 215/354
2,717,096 A * 9/1955 Henderson ..... B60K 15/0406 220/301
2,734,651 A * 2/1956 Lindström ..... B65D 41/0435 215/349

(Continued)

FOREIGN PATENT DOCUMENTS

EP 4414285 A1 * 8/2024 ..... B65D 43/0218

*Primary Examiner* — Gideon R Weinerth
(74) *Attorney, Agent, or Firm* — MUNCY, GEISSLER, OLDS & LOWE, PC

(57) ABSTRACT

A gasket body, a detachable sealing cover and a container, include a body, a sealing element and a magnet. The body includes a main plane and a peripheral wall located on the periphery of the main plane. The sealing element is connected to the periphery of the peripheral wall. The main plane is provided with a mounting blind hole, which has an opening facing inward. The magnet is mounted into the mounting blind hole from the opening. The main plane is provided with through holes. Due to its magnetism, the magnet located inside the mounting blind hole can facilitate the connection or removal of the sealing cover, the sealing element on the periphery can improve sealing ability, and when the sealing cover is closed, part of the air in the container can be discharged from the through holes and sealing element, forming a stronger negative pressure and enhancing sealing ability.

9 Claims, 3 Drawing Sheets

(56) References Cited

U.S. PATENT DOCUMENTS 2,826,328 A * 3/1956 Moen ..... B65D 55/16 29/559
2,758,743 A * 8/1956 Smith ..... B60K 15/0406 220/293
2,761,717 A * 9/1956 Mahlke ..... B65D 25/20 55/DIG. 26
2,893,585 A * 7/1959 Hoef ..... B65D 51/24 215/DIG. 1
2,916,174 A * 12/1959 Orr ..... B65D 41/0435 215/354
2,980,276 A * 4/1961 Doria ..... B65D 41/0435 215/260
3,148,856 A * 9/1964 Orlando ..... G09F 17/00 248/205.6
3,425,579 A * 2/1969 Braun ..... B65D 41/0435 215/329
3,961,721 A * 6/1976 Gordon ..... B65D 43/169 220/837
4,110,552 A * 8/1978 Lombardi ..... H05K 9/0007 220/230
4,223,800 A * 9/1980 Fishman ..... B65D 43/022 220/521
4,744,481 A * 5/1988 Morgan, Jr. ..... B65D 41/045 215/341
4,896,782 A * 1/1990 Hawkins ..... B65D 51/18 215/276
5,161,711 A * 11/1992 Picozza ..... B65D 43/021 220/256.1
8,240,512 B2 * 8/2012 Sunatori ..... B65D 51/242 211/DIG. 1
8,251,221 B1 * 8/2012 Castaneda ..... B65B 5/04 206/592
8,540,075 B2 * 9/2013 Chau ..... A24F 15/12 206/242
8,556,095 B1 * 10/2013 Yamaguchi ..... A44C 15/005 215/400
10,858,155 B1 * 12/2020 Caruso ..... B65D 21/0217
2004/0178307 A1 * 9/2004 Sim ..... F16B 47/00 248/205.6
2009/0314778 A1 * 12/2009 Back ..... B65D 41/28 220/256.1
2016/0081436 A1 * 3/2016 Sugai ..... G09F 7/04 24/303
2018/0229899 A1 * 8/2018 Sung ..... B65D 41/0435
2019/0225388 A1 * 7/2019 Wasso, Jr. ..... B65D 51/24
2023/0072355 A1 * 3/2023 Lan ..... B65D 41/0442
2023/0146911 A1 * 5/2023 Wilson ..... A47G 19/2288 220/574
2024/0246732 A1 * 7/2024 Hu ..... B65D 43/02
2024/0262575 A1 * 8/2024 Leung ..... B65D 53/02

* cited by examiner

GASKET BODY, DETACHABLE SEALING COVER AND CONTAINER

TECHNICAL FIELD

The present invention relates to the field of container sealing covers, particularly to a gasket body, a detachable sealing cover and a container.

BACKGROUND ART

A wide variety of sealing containers and their corresponding sealing covers have been available on the market for a long time, and most of the existing sealing covers use seal rings on the cover bodies to enhance their sealing performance. Generally, the cover bodies are made of metals or plastics, while the seal rings are made of soft plastics, both of which are recyclable materials. However, most of the existing seal rings are bonded to the cover bodies using strong adhesives. The strong adhesives are not only harmful to the environment but also make it difficult to separate the cover from the seal ring, thereby not recyclable, resulting in waste of resources and environmental damage.

Further, the existing sealing containers have a single function, only provide two states of sealing and opening, and not provide a design of the cover body which can not only be open and sealed and also partially cover the container.

SUMMARY OF THE INVENTION

The first objective of the present invention is to provide a gasket body that can be easily assembled, disassembled and produced.

The second objective of the present invention is to provide a detachable sealing cover having the foregoing gasket body.

The third objective of the present invention is to provide a container with a container having the foregoing sealing cover.

In order to achieve the first objective of the present invention, the present invention provides a gasket body, comprising a body, a sealing element and a magnet; the body comprises a main plane and a peripheral wall located on the periphery of the main plane, the sealing element is connected to the periphery of the peripheral wall, the main plane is provided with a mounting blind hole, which has an opening facing inward, the magnet is mounted into the mounting blind hole from the opening, and the main plane is provided with through holes.

From the foregoing solution, it can be seen that the magnet located inside the mounting blind hole can facilitate the connection or removal of the sealing cover by means of the magnetism of the magnet, the sealing element on the periphery can improve sealing ability, and when the sealing cover is closed, part of the air in the bottle can be discharged from the through holes and sealing element, forming a stronger negative pressure and enhancing sealing ability.

As a further solution, the mounting blind hole is located at the center of the main plane and the through holes are located on the radial periphery of the mounting blind hole.

As a further solution, the part of the main plane located at the mounting blind hole protrudes outward.

As a further solution, the main plane is provided with a plurality of through holes on the periphery of the mounting blind hole.

It can be seen that arranging the magnet in the middle part and raising a part of the main plane outward not only improves the connection stability of the gasket body but also can make the main plane closer to the base of the sealing cover, and the plurality of through holes can improve the air discharge effect.

As a further solution, a locking flange is circumferentially arranged on the radial outer wall of the peripheral wall, and the sealing element is circumferentially provided with a locking slot, which is sleeved outside the locking flange.

It can be seen that sleeving the locking slot outside the locking flange can improve the stability of assembly between the sealing element and the body.

As a further solution, the sealing element is circumferentially provided with a first sealing face along the radial outer side of the locking flange, and the connecting face of the magnet located at the opening is on the same plane of the first sealing face.

As a further solution, the sealing element is circumferentially provided with a second sealing face on the radial outer side of the locking flange, and the second sealing face is located outside the first sealing face.

It can be seen that the first sealing face and the second sealing face, which are located on the outside and inside respectively, can be used to seal different positions of the container opening, thus further improving the sealing performance.

In order to achieve the second objective of the present invention, the present invention provides a detachable sealing cover, comprising a lid and the gasket body in the foregoing solution, and the lid is made of a metal material that can be magnetically attracted and comprises a base and a ring wall located on the periphery of the base; the gasket body is arranged inside the lid, the magnet is magnetically connected to the base, and the outer edge of the sealing element is adjacent to the ring wall.

As a further solution, the axial thickness of the lid is greater than the axial thickness of the sealing element.

In order to achieve the third objective of the present invention, the present invention provides a container, comprising a container body and the detachable sealing cover in the foregoing solution, and the sealing cover is connected to the container body.

From the foregoing solution, it can be seen that the magnetic connection between the magnet and the base facilitates the assembly and disassembly between the lid and the gasket body, thereby facilitating the recovery of the lid, and the adjacency between the outer edge of the sealing element and the ring wall and the layout of a greater axial thickness of the lid further improve the sealing performance of the sealing cover.

DESCRIPTION OF REFERENCE SIGNS

1—sealing cover; 11—lid; 111—base; 112—side wall;
2—gasket body; 21—body; 22—sealing element; 23—magnet;

211—through hole; 212—protrusion; 213—blind hole; 214—main plane;

215—peripheral wall; 216—locking flange; 221—locking slot;

222—first sealing face; 223—second sealing face; 231—connecting face.

The present invention will now be further described by referring to the accompanying drawings and embodiments.

DETAILED DESCRIPTION

Embodiment of Gasket Body

Figure 1:
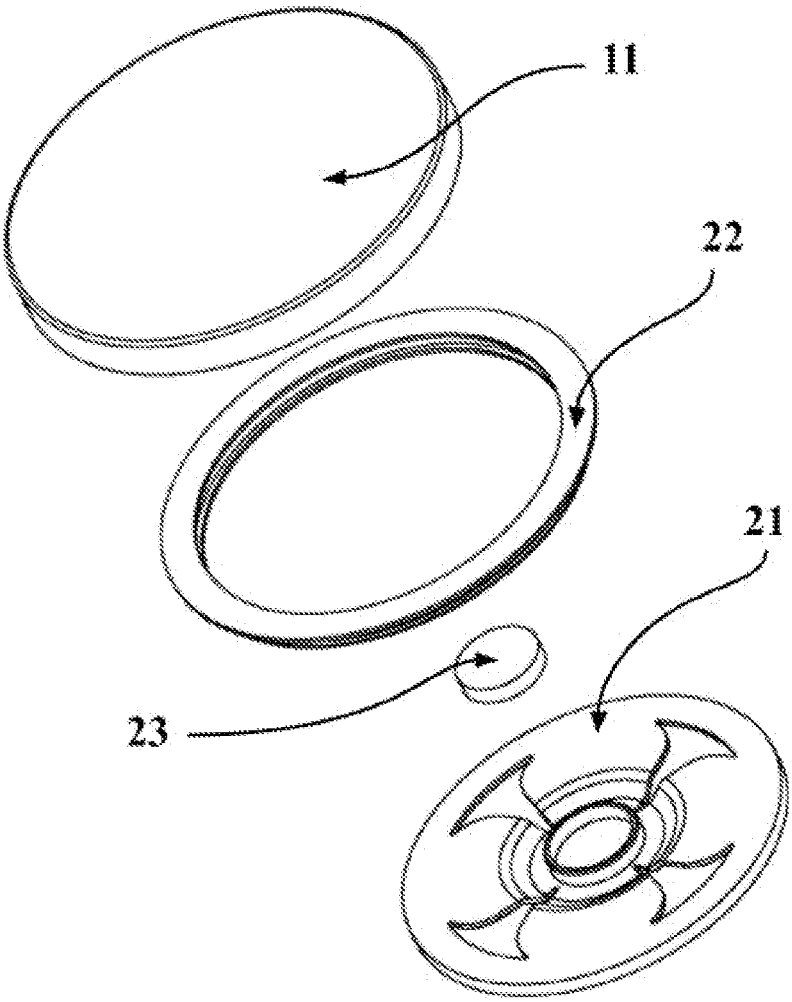
FIG. 1 is an exploded view of all parts of a sealing cover embodiment of the present invention.
Figure 2:
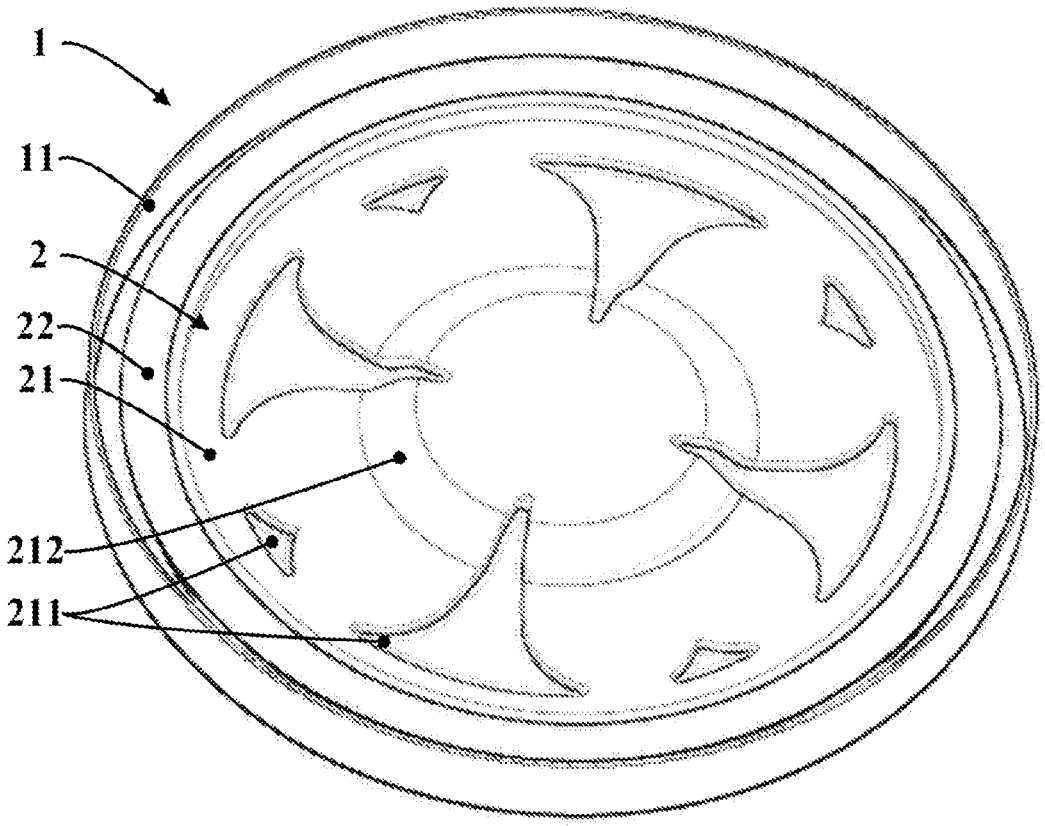
FIG. 2 is a structural view of a sealing cover embodiment of the present invention.
Figure 3:
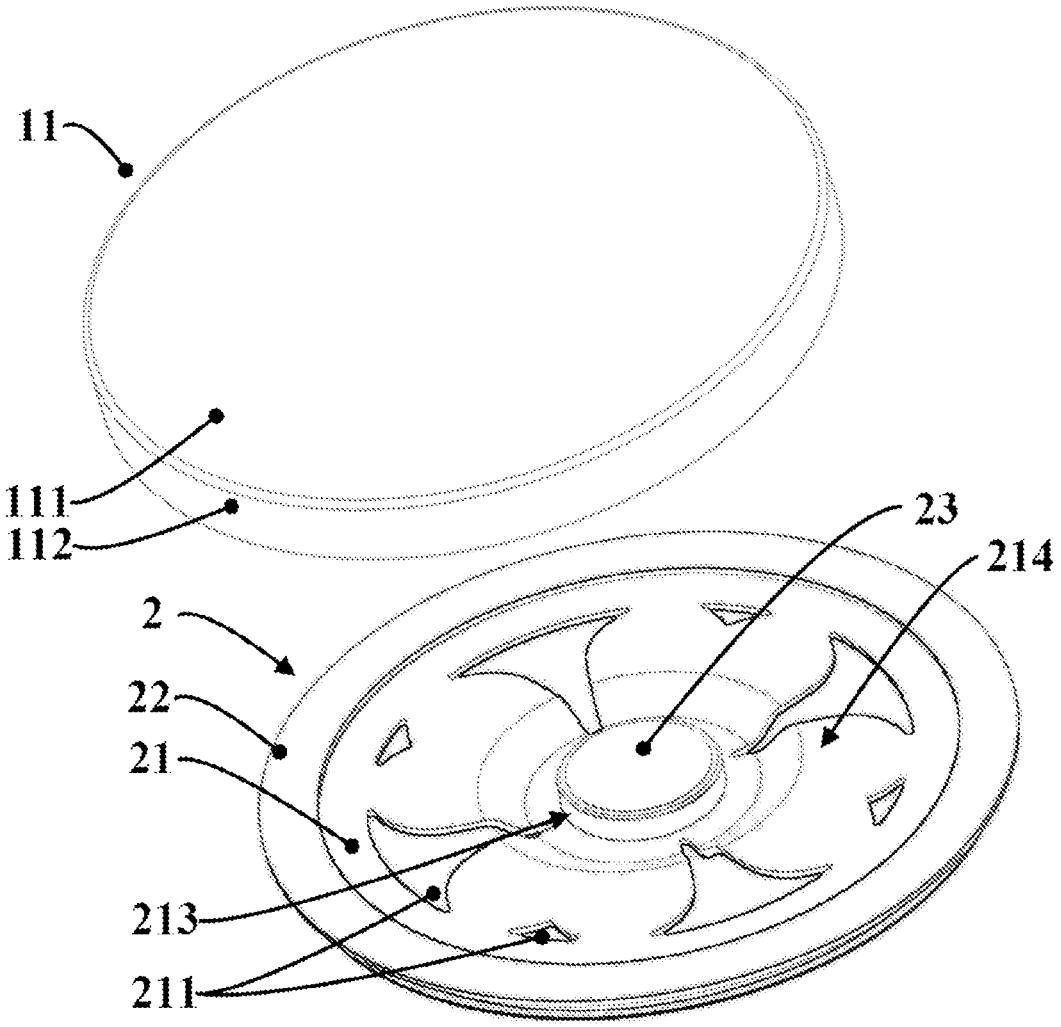
FIG. 3 is an exploded view of some parts of a sealing cover embodiment of the present invention.
Figure 4:
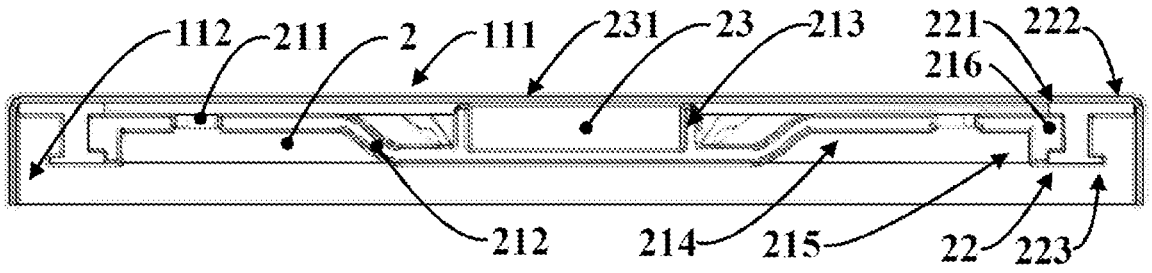
FIG. 4 is a sectional view of a sealing cover embodiment of the present invention.

As shown in FIG. 1 to FIG. 3, the gasket body 2 comprises a body 21, a sealing element 22 and a magnet 23, the body 21 comprises a main plane 214 and a peripheral wall 215 located on the periphery of the main plane 214, a locking flange 216 is circumferentially arranged on the radial outer wall of the peripheral wall 215, the sealing element 22 is connected on the periphery of the peripheral wall 215, the main plane 214 is provided with a mounting blind hole 213 at the center of the main plane 214, the mounting blind hole 213 has an opening facing inward to the lid 11, the part of the main plane 214 located at the mounting blind hole 213 protrudes outward, the protrusion 212 protrudes outward away from the lid 11, the magnet 23 is mounted into the mounting blind hole 213 from the opening, the main plane 214 is provided with a plurality of through holes 211 on the radial periphery of the mounting blind hole 213, and the plurality of through holes 211 are in different sizes and shapes and can be combined into various patterns or shapes. Although the body is round and the sealing element is annular in the embodiment, the body can be in other polygons, too, e.g., triangle, square or star, and the sealing element surrounds the outer edge of the body. In this way, the present invention can be implemented, too.

The sealing element 22 is circumferentially provided with a locking slot 221. When the sealing element 22 is connected to the body 21, the locking slot 221 is sleeved outside the locking flange 216. Specifically, the body 21 can be made of hard plastics, such as PP, PE, PC, ABS and other regular plastics, while the sealing element 22 can be made of soft plastics, such as TPE, TPU, TPR and other materials, and there are various production methods. For example, the sealing element 22 and the body 21 are injection-molded, respectively and then are assembled. A better production method is to form the sealing element 22 and the body 21 through secondary injection molding, i.e., to produce the body by the method of injection molding at first, and then conduct injection molding again around the body to form an integrated component including the sealing element combined with the body. This production method avoids the use of adhesives and other non-environment-friendly materials. As the sealing element and the body are both plastic products and adopt an integrated design, they are more suitable for recovery.

The sealing element 22 is circumferentially provided with a first sealing face 222 on the radial outer side of the locking flange 216, the first sealing face 222 is adjacent to the base 111 of the lid 11, and the connecting face 231 of the magnet 23 at the opening is on the same plane of the first sealing face 222. The sealing element is circumferentially provided with a second sealing face 223 on the radial outer side of the locking flange 216. Compared with the first sealing face 222, the second sealing face 223 is farther from the base 111 of the lid 11, i.e., the second sealing face 223 is located outside the first sealing face 222, the radial length of the first sealing face 222 is greater than that of the second sealing face 223, the first sealing face 222 and the second sealing face 223 extend radially, respectively, and a sealing slot is formed between the first sealing face 222 and the second sealing face 223.

A separate gasket body is unable to provide a complete sealing function, but as there are through holes on the gasket body, and the gasket body matched with a container in an appropriate size can serve as a cover partially covering the container, a container filled with dry fragrant flower for example. As another use, as the gasket body has a magnet, it can be attached to a metal plate as an ornament, for example, a refrigerator magnet for fixing notes on a refrigerator.

Embodiment of Detachable Sealing Cover

The sealing cover 1 comprises a lid 11 and the gasket body 2 in the foregoing embodiment. The lid 11 is made of a metallic material that can be magnetically attracted. The lid 11 comprises a base 111 and a side wall 112 located on the periphery of the base 111, the axial thickness of the lid 11 is greater than the axial thickness of the sealing element 22, the gasket body 2 is arranged inside the lid 11, the magnet 23 is magnetically connected to the base 111, the first sealing face 222 is adjacent to the base 111, the outer edge of the sealing element 22, i.e., the outer edge of the first sealing face 222, is adjacent to the side wall 112, and the second sealing face 223 is separated from the side wall 112.

Embodiment of Container

The container comprises a container body and the detachable sealing cover 1 in the foregoing embodiment. The container body is provided with a ring wall at the opening. When the sealing cover 1 is connected to the container body, the outer wall of the ring wall is fit inside the side wall 112 and located within the sealing slot, the axial end face of the ring wall is in interference fit with the first sealing face 222, and the inner wall of the ring wall is in interference fit with the second sealing face 223. When the sealing cover 1 is closed, part of the air in the container can be ejected out of the body from the through holes 211 and the outer edge of the first sealing face 222 of the sealing element 22, forming a stronger negative pressure and enhancing sealing ability. Further, at least one notch is arranged on the second sealing face 223. When the sealing element 22 is close to the ring wall at the opening, the second sealing face 223 can be more easily deformed to extend into the inner wall. Likewise, when the sealing cover is moved away from the container body, as the second sealing face 223 is more easily deformed than the first sealing face 222 does, a relatively smaller friction force is generated with the opening ring wall, thereby making it easier to pull out the sealing cover.

It can be seen that the magnet located inside the mounting blind hole can facilitate the connection or removal of the sealing cover by means of the magnetism of the magnet, the sealing element on the periphery can improve sealing ability, and when the sealing cover is closed, part of the air in the container can be ejected from the through holes and sealing element, forming a stronger negative pressure and enhancing sealing ability. Further, the gasket body can be separated from the sealing cover, so it facilitates the recovery of the sealing cover and can also be used as a refrigerator magnet. Still further, the sealing cover may also be provided with vents, the gasket body is detachably connected to the sealing cover by means of magnetism and can be used on a container for aromatherapy or filled with balm.

The invention claimed is:

1. A gasket body, comprising:

a main body comprising: a main plane, a peripheral wall, a plurality of through holes located on the main plane, and a recessed mounting hole defining an upward facing opening;

a sealing element secured to the main body at the peripheral wall; and a magnet mounted within the mounting hole.

2. The gasket body according to claim 1, wherein the mounting hole is centrally located on the main plane and the through holes are radially located around a periphery of the mounting hole.

3. The gasket body according to claim 2, wherein the mounting hole forms a depression which protrudes downwards from the main plane opposite the upward facing opening.

4. The gasket body according to claim 3, wherein the peripheral wall includes a locking flange and the sealing element includes a locking slot configured to be matingly seated around the locking flange.

5. The gasket body according to claim 4, wherein the sealing element has a first sealing face positioned radially outside of the locking slot; and wherein a planar upper connecting face of the magnet is flush with the first sealing face.

6. The gasket body according to claim 5, wherein the sealing element includes a second sealing face provided radially opposite the locking slot and vertically below the first sealing face.

7. A detachable sealing cover assembly comprising: the gasket body of claim 5 and a ferromagnetic metallic lid, wherein the lid comprises a base and a peripheral side wall; wherein, in an assembled position, the magnet acts to detachably hold the gasket body within the lid and against the base at the upper connecting face and an outer edge of the first sealing face is adjacent to the side wall.

8. The detachable sealing cover assembly according to claim 7, wherein the vertical height of the lid is greater than the vertical height of the sealing element.

9. A container comprising the detachable sealing cover assembly of claim 7 wherein the lid and gasket body are attachable to the container.

* * * * *